US006213713B1

(12) United States Patent
Dickmann

(10) Patent No.: US 6,213,713 B1
(45) Date of Patent: Apr. 10, 2001

(54) APPARATUS FOR INDICATING PITCH ANGLE OF A PROPELLER BLADE

(75) Inventor: Carl A. Dickmann, Agawam, MA (US)

(73) Assignee: United Technologies Corporation, Windsor Locks, CT (US)

( * ) Notice: Subject to any disclaimer, the term of this patent is extended or adjusted under 35 U.S.C. 154(b) by 0 days.

(21) Appl. No.: 09/224,523

(22) Filed: Dec. 31, 1998

(51) Int. Cl.[7] ..... B64C 11/00
(52) U.S. Cl. ..... 416/61
(58) Field of Search ..... 416/61, 31; 324/166, 324/173, 174, 207.14, 207.23, 207.25; 73/660

(56) References Cited

U.S. PATENT DOCUMENTS

| | | | | |
|---|---|---|---|---|
| 2,485,245 | * | 10/1949 | Schoenbaum | 170/160.22 |
| 2,986,222 | | 5/1961 | Biermann | 170/160.2 |
| 3,190,125 | * | 6/1965 | Holz | 73/432 |
| 3,249,159 | | 5/1966 | Biermann | 170/160.2 |
| 3,380,535 | | 4/1968 | Biermann | 170/160.2 |
| 3,446,289 | | 5/1969 | Morris, Jr. | 170/160.2 |
| 3,895,883 | | 7/1975 | Pedersen | 416/61 |
| 4,056,888 | | 11/1977 | Hughey, Jr. | 33/174 |
| 4,411,073 | | 10/1983 | Ryan | 33/174 |
| 4,648,798 | | 3/1987 | Voisard | 416/48 |
| 4,900,280 | | 2/1990 | Midttun | 440/50 |
| 4,906,213 | | 3/1990 | Esthimer | 440/50 |
| 5,152,071 | | 10/1992 | Bergeron | 33/530 |
| 5,174,718 | | 12/1992 | Lampeter et al. | 416/48 |
| 5,213,472 | | 5/1993 | Dumais | 416/61 |
| 5,284,418 | | 2/1994 | Moriya | 416/35 |
| 5,299,911 | | 4/1994 | Moriya | 416/35 |
| 5,865,599 | * | 2/1999 | Pruden et al. | 416/61 |

FOREIGN PATENT DOCUMENTS 10-222229 8/1998 (JP) .

* cited by examiner

*Primary Examiner*—Edward K. Look
*Assistant Examiner*—James M McAleenan

(57) ABSTRACT

An apparatus for detecting the pitch angle of a propeller blade comprises a sensor and two transmitters. The transmitters are strategically located so as to identify a first fixed reference point on the propeller hub and a second movable point on the propeller blade. The sensor is mounted on a non-moving reference such as the engine housing. The sensor detects the time difference in signal arrival from each magnetic transmitter as they rotate on the propeller assembly and pass by the sensor. The fixed transmitter, although spinning with the propeller hub, does not move relative to the hub itself, and is mounted in a fixed position relative to the hub such as on the bulkhead plate. Each time the fixed transmitter passes by the sensor it generates a reference signal. The movable transmitter moves with the propeller blade as it rotates about the pitch axis thus changing the distance between the two transmitters. After the fixed sensor passes by the sensor, the movable transmitter passes by the sensor generating a second signal such that there is a measurable difference in the time of arrival between the two signals. The measurable difference is indicative of the blade pitch angle.

6 Claims, 4 Drawing Sheets

APPARATUS FOR INDICATING PITCH ANGLE OF A PROPELLER BLADE

BACKGROUND OF THE INVENTION

1. Technical Field

The present invention is generally directed to the detecting and measuring of a higher order degree of rotation of an articulated member undergoing multiple degrees of rotation. More particularly, the present invention is directed to the detecting and measuring of the pitch angle of a propeller blade. The first degree of rotation is defined as the blade rotation about the hub axis and is commonly known as propeller revolutions per minute (rpm). The second degree of rotation is defined as blade rotation about the longitudinal axis of the blade and is commonly known as pitch angle.

2. Prior Art

Rotating blade assemblies have long been used to convert rotating shaft power into useful work. One specialized and well known blade assembly is a propeller. A propeller normally comprises a hub rotated by a shaft. The hub usually has at least two propeller blades protruding from the hub such that the blades are orthogonal to the shaft. Each blade has an aerodynamic profile and is rotated through a fluid medium such that each blade generates a 'lifting' force based on the Bernoulli principle. An important parameter in determining the amount of thrust generated by the propeller is the angle of attack of the blade. The angle of attack is critical in application of the Bernoulli principal because it determines the difference between useful work being performed or a stalled blade where no useful work is performed. It is well know in the art that without the proper angle of attack, increasing propeller revolutions per minute will not increase the amount of useful work output. Therefore the angle of attack is a critical parameter to be known in an operating propeller. The pitch angle of a propeller blade is that angle between the chord of the blade and the plane it rotates in about the hub. It is a very useful parameter in determining the angle of attack.

Early propellers were designed with each blade having a fixed pitch angle. Although the blade rotated about the hub at varying propeller RPM, its pitch angle remained constant. It soon became clear to the early inventors that due to the constantly changing environment a propeller operated in, a fixed pitch propeller was not a very efficient solution. Thus arose the impetus for inventors to discover ways to vary the pitch of each blade while the propeller was spinning. Once variable pitch propellers were discovered, it greatly changed the way propellers are used and controlled. Pitch angle is now varied dynamically for a variety of reasons. For example, when a power plant fails and shaft power is reduced significantly or eliminated, a fixed pitch propeller will create a large drag or negative thrust. However a variable pitch propeller can be 'feathered' so that each blade is rotated until its chord is parallel to the shaft axis and therefore the blades generate only a small parasitic drag. Blade angle can also be varied to increase or reduce thrust without varying propeller rpm, i.e., a constant speed propeller. In some propeller assemblies pitch angle can be varied so that the blades generate reverse thrust, also known as the 'beta' range.

An operator or control system is normally used to command the pitch angle of a propeller blade in an operating environment. Simultaneously, the operator or control system usually requires some feedback as to what the blade pitch angle is. Initially, feedback was a position indication of a control arm driving the mechanical linkage to alter pitch angle. This was actually an 'open loop' system in that the operator adjusted a power setting and a propeller rpm setting without truly measuring a pitch angle. The control system would increase or decrease blade pitch to achieve the commanded propeller rpm setting. Thus the true blade pitch angle was unknown.

Variable pitch propeller systems typically incorporate a hub which encloses a chamber within its interior wherein a pitch angle change actuation system is disposed in operative association with the propeller blades. The actuation system functions to selectively change the pitch angle of the blades thereby altering the lift and drag characteristics of the propeller blades.

In most modern aircraft, the pitch change actuator is of the hydromechanical type wherein an output member, typically a piston, is driven in response to adjustments in the pressure of the hydraulic fluid which drives the actuator. The adjustments in fluid pressure are typically affected by either a hydromechanical or electronic control system which monitors engine speed and causes, by way of collateral apparatus, a change in fluid pressure whenever the monitored engine speed departs from the desired engine speed setting.

Such hydromechanical pitch change actuation systems are well known in the art. For example, commonly assigned U.S. Pat. No. 4,523,891 to Schwartz and Duchesneau discloses a conventional pitch actuation system wherein each propeller blade is operatively connected to a piston which is driven by the pressure of a fluid which is selectively directed in response to a departure from desired engine speed against the opposite faces of the piston thereby causing a linear displacement of the piston and a resultant change in pitch of the blades operatively connected to the piston. The piston is reciprocally moveable within a cylinder disposed within the hub about a torque tube which extends from the fluid supply to the piston. As shown in U.S. Pat. No. 4,523,891, the pressure fluid is conveyed through a conduit within the torque tube from the fluid supply to a valve associated with the piston which, depending upon its position, selectively directs the fluid against either the front or the rear face of the piston thereby causing the piston to move linearly thereby rotating the blade or blades associated therewith to effectuate the change in pitch.

In the foregoing systems, however, there is no measurement of the actual blade pitch angle. The present invention provides a novel method and apparatus to solve this problem.

SUMMARY OF THE INVENTION

In accordance with a preferred embodiment of the present invention, an apparatus for detecting the pitch angle of a propeller blade comprises a system of a magnetic sensor having a centered magnetic pole piece and two remote magnetic transmitters. The transmitters are strategically located so as to identify a first fixed reference point on the propeller hub and a second movable point on the propeller blade. The magnetic sensor is mounted on a non-moving reference such as the engine housing. The magnetic sensor detects a magnetic pulse from each magnetic transmitter as they rotate on the propeller assembly and pass by the magnetic sensor. The fixed magnetic transmitter, although spinning with the propeller hub, does not move relative to the hub itself because it is mounted on a bulkhead plate which is fixed to and rotates with the hub. Each time the fixed magnetic transmitter passes by the sensor it generates a reference signal which is relayed to a signal processor from the sensor. After the fixed transmitter passes by the sensor, the movable transmitter passes by the sensor generating a second signal which is also relayed to the processor. The movable transmitter moves with the propeller blade as it rotates about the pitch axis in such a manner so as to change the angular distance between the two transmitters. This change, either an increase or decrease, in angular distance between the two transmitters, causes a corresponding change in the relative arrival time of the movable transmitter magnetic pulse at the sensor given a propeller spinning at a constant rate. The signal processor receives the pair of signals and determines the pitch angle of the propeller blade from the difference in the time of arrival of the two signals.

The above-discussed and other features and advantages of the present invention will be appreciated and understood by those skilled in the art from the following detailed description and drawings.

BRIEF DESCRIPTION OF THE DRAWINGS

Referring now to the drawings wherein like elements are numbered alike in the several FIGURES.

DETAILED DESCRIPTION OF THE INVENTION

Figure 1:
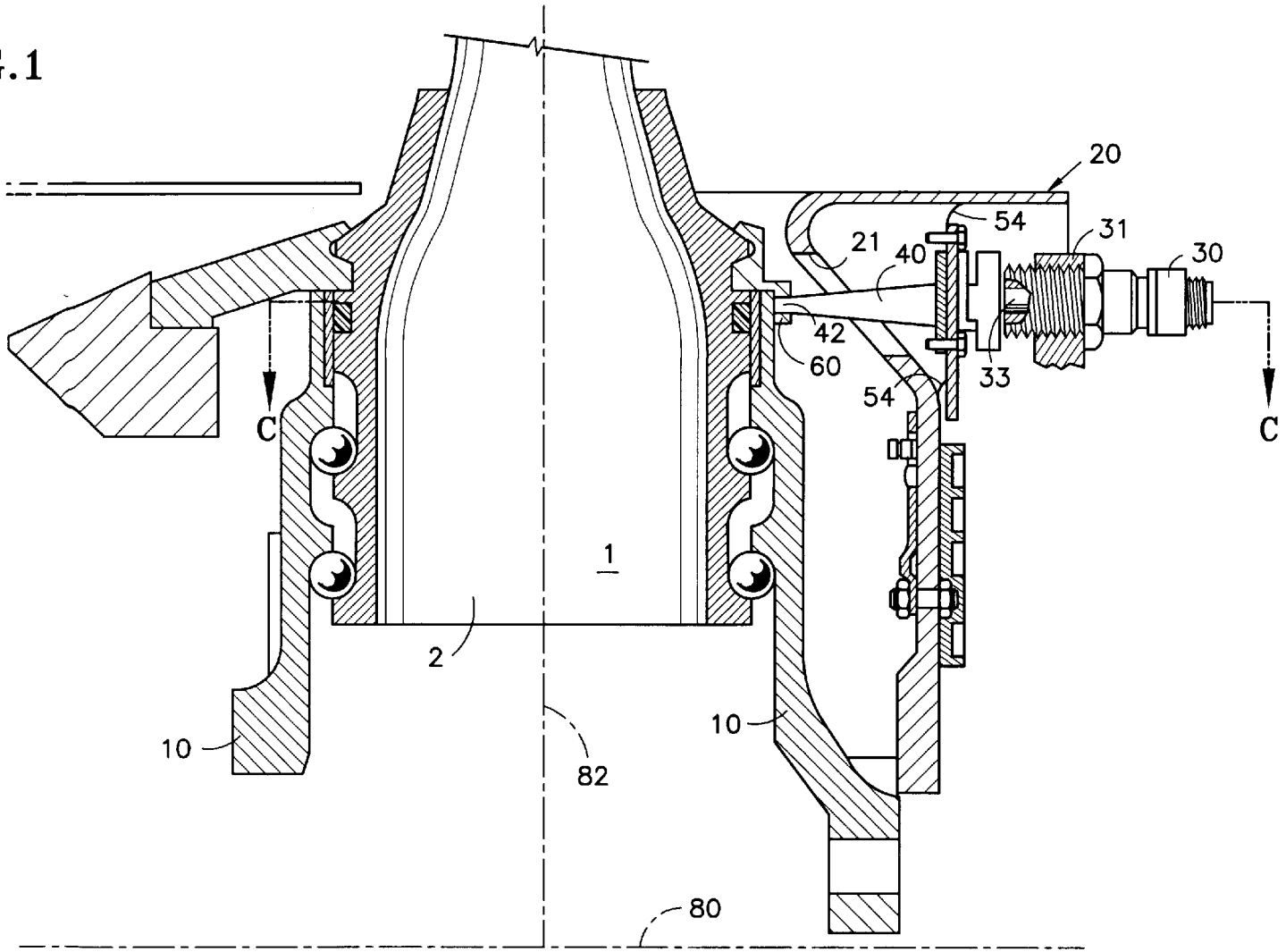
FIG. 1 is a cutaway view of a propeller hub assembly illustrating the propeller blade pitch angle detector.

Referring to FIG. 1, a cutaway view of a propeller hub assembly 10 illustrating some of the components of the propeller blade pitch angle detector is shown. A propeller blade 1 is captured and rotatably held by a propeller hub assembly 10 in a manner well known in the art. As the propeller hub assembly 10 is spinning about the propeller axis 80, the propeller blade 1 is caused to rotate about a pitch axis 82 through a range of various pitch angles, from feather to reverse, also well known in the art. A magnetic sensor 30 having a centered magnetic pole piece 33 is mounted at a stationary position on the engine frame 31 so as to be in close proximity to a bulkhead plate 20. The bulkhead plate 20 which is attached to the propeller hub assembly 10 spins with it about propeller axis 80. A sliding magnetic target 40 has an overall T-shape with it's head 41 towards the magnetic sensor 30 and its tail 42 slidably captured in a grooved ring 60. A through-slot 21 is cut in the bulkhead plate 20 to allow the sliding magnetic target 40 to move in an up and down direction with the grooved ring 60 as described in greater detail below.

Figure 2:
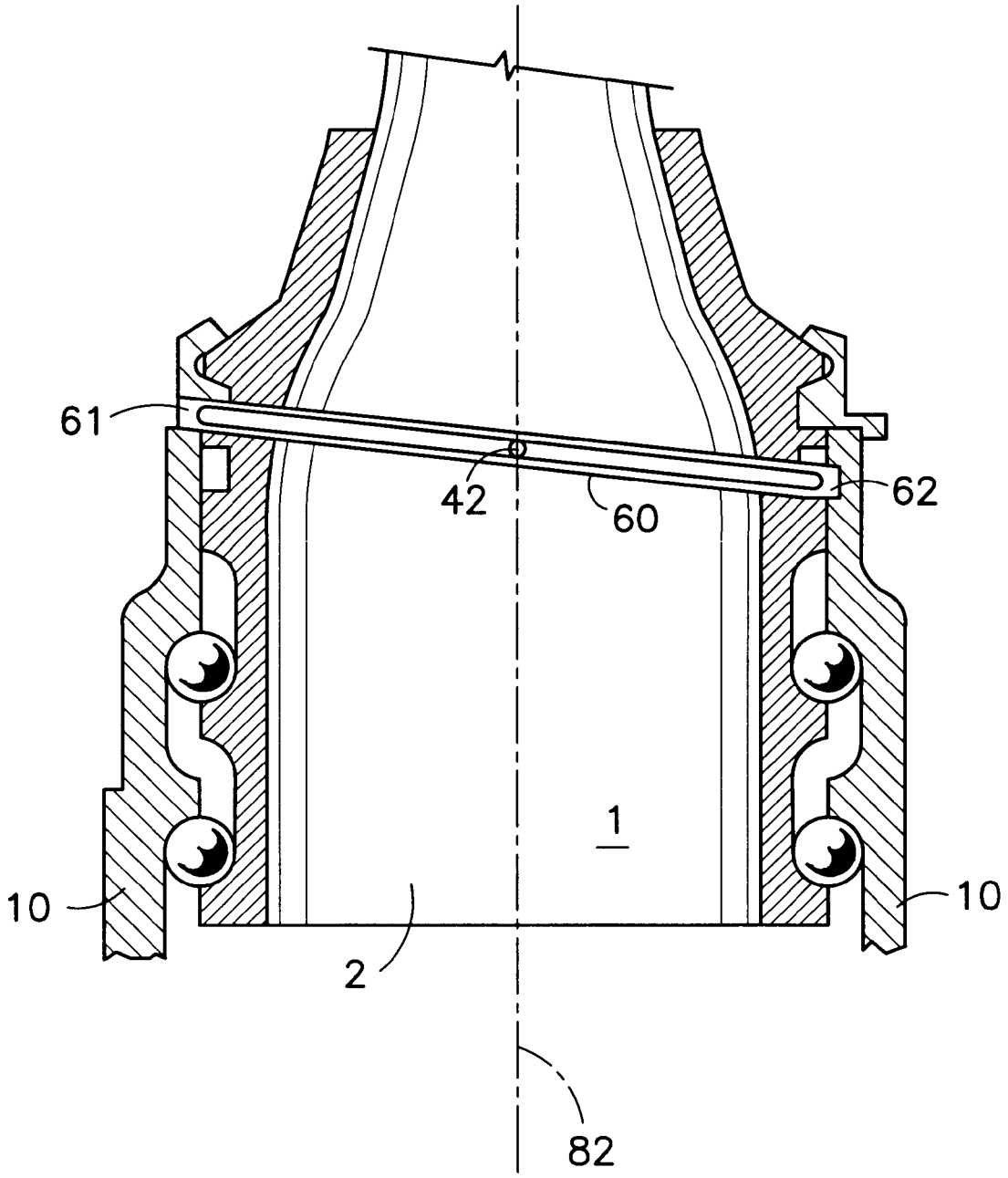
FIG. 2 is a side elevation view of a propeller blade illustrating the grooved ring.

Referring to FIG. 2, a side elevation view of a propeller blade 1 illustrating a grooved ring 60 is shown. The grooved ring 60 is spirally mounted on the propeller blade 1 such that the left end 61 is approximately one inch higher than the right end 62. The grooved ring 60 is fixed to the propeller blade 1 so that when the propeller blade 1 rotates about the pitch axis 82, the tail 42 of the sliding magnetic target 40 is driven either up or down depending on the direction of rotation by the propeller blade 1. Thus the rotational motion of the propeller blade 1 as it varies the pitch angle 90 is converted to a translational motion in the sliding magnetic target 40 as described in greater detail below.

Figure 3A:
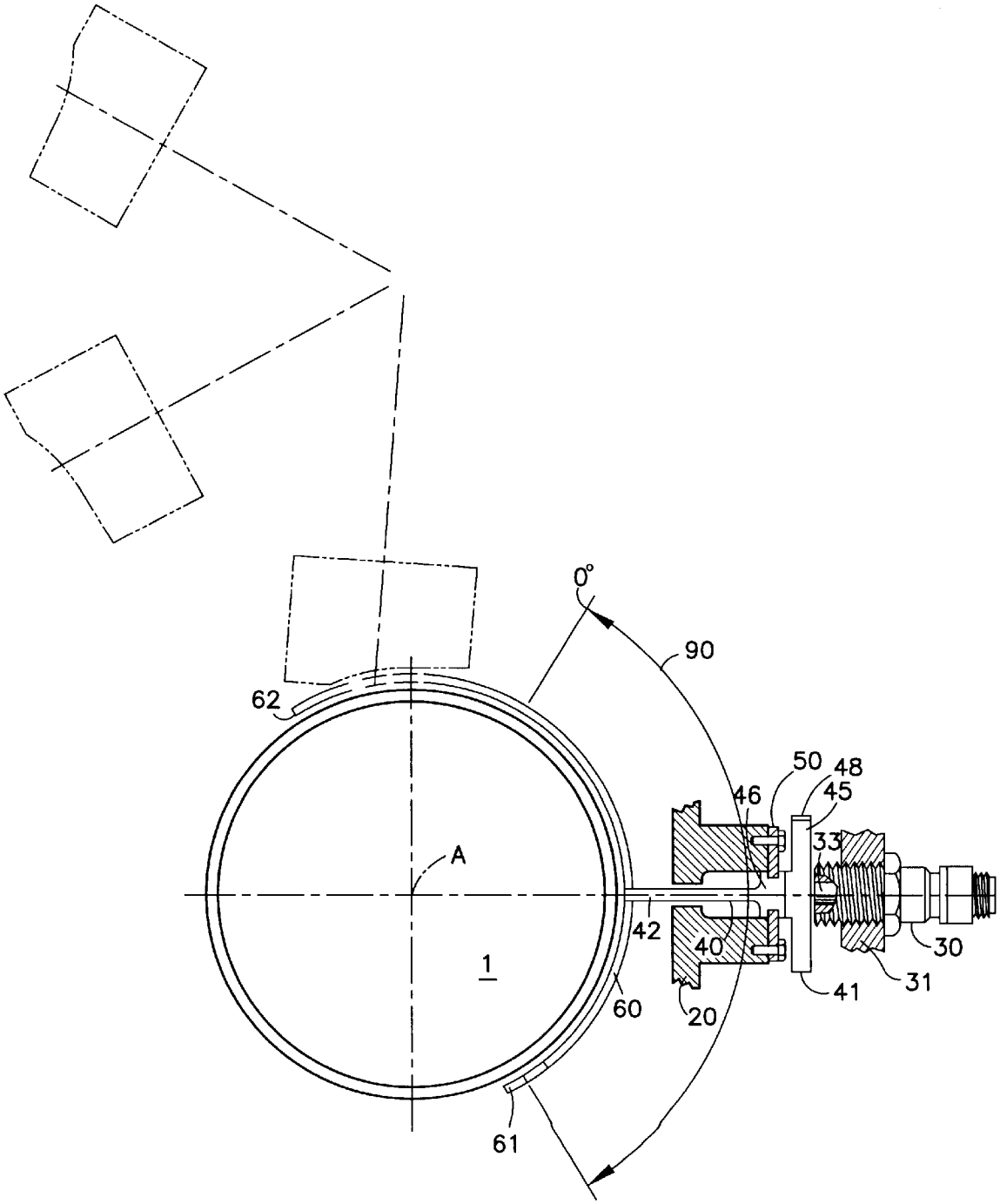
FIG. 3A is a cross-sectional view of FIG. 1 taken at line C—C illustrating a propeller blade, a sliding magnetic target, and a magnetic sensor having a centered magnetic pole piece.

Referring to FIG. 3A, a cross-sectional view of FIG. 1 taken at line C—C illustrating a propeller blade 1, a sliding magnetic target 40, a magnetic sensor 30 with a centered magnetic pole piece 33, and various blade pitch angles is shown. The grooved ring 60 is mounted on the circumference of the propeller root 2 (see FIG. 2) and extends approximately half way around the propeller blade 1. When the propeller blade 1 rotates either clockwise or counter-clockwise as viewed in FIG. 3, the grooved ring 60 drives the tail 42 of the sliding magnetic target 40 into or out of FIG. 3. Rotation of the grooved ring about the second axis 82 causes translation of the tail 42 along the second axis. It should be noted that the pitch axis 82 is perpendicular out of FIG. 3 at point A.

Figure 3B:
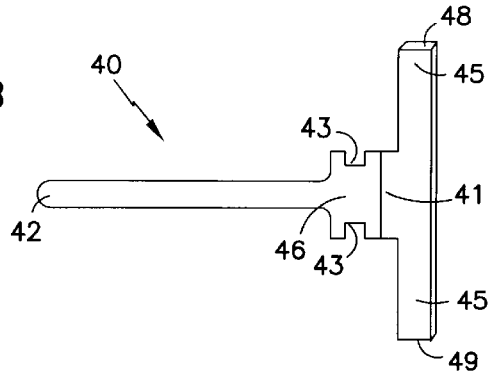
FIG. 3B is a top plan view of a sliding magnetic target illustrating a head and tail.

Referring to FIG. 3B, a top plan view of a sliding magnetic target 40 illustrating a head 41 and tail 42 is shown. The head 41 is composed of two parts: a ferrous metal bar 45 and an H-shaped section 46 which has two symmetrical and opposing head slots 43. Each head slot 43 receives and slides on the edge of a target retainer plate 50 as described in greater detail below. The ferrous metal bar 45 is made from a suitable magnetic material so that it has uniform magnetic properties distributed from a first end 48 to a second end 49. As can be seen by close inspection, the side edge of the first end 48 is visible while the side edge of the second end 49 is not. This is because the ferrous metal bar 45 is not co-planar with the rest of the sliding magnetic target 40. In fact it is this angle which generates the difference in the magnetic signal detected by the magnetic sensor 30 when the ferrous metal bar 45 passes by. This offset angle is more self evident in FIGS. 4A and 4B.

Figure 4A:
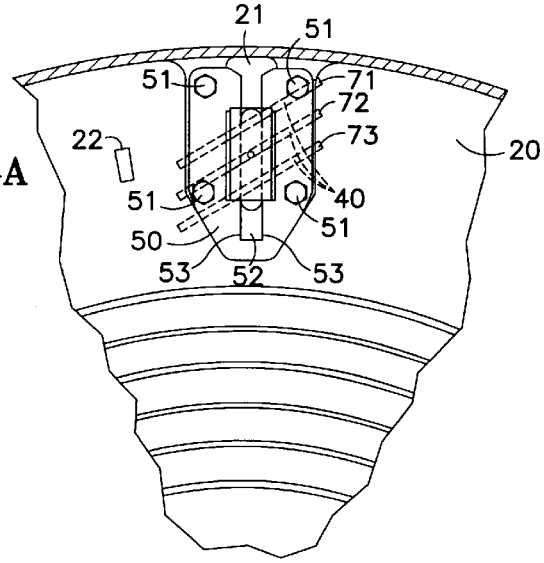
FIG. 4A is a front elevation view of the bulkhead plate illustrating various positions of the sliding magnetic target.

Referring to FIG. 4A, a front elevation view of the bulkhead plate 20 illustrating various positions of the sliding magnetic target 40 is shown. A through-slot 21 has been stamped or cut in the bulkhead plate 20. A U-shaped target retainer plate 50 is held in place in line with the through-slot 21 by four fasteners 51 on a retainer support member 54 (see FIG. 1). The target retainer plate 50 has a retainer plate slot 52 in which the sliding magnetic target 40 is slidably retained. Each head slot 43 of the sliding magnetic target 40 captures and slides up and down on an inside edge 53 of the U-shaped target retainer plate 50. Three positions of the sliding magnetic target 40 are shown. When the pitch angle 90 of the propeller blade 1 is in reverse, the sliding magnetic target 40 will be in the upper-most position 71. When the pitch angle 90 of the propeller blade 1 is in mid-range, the sliding magnetic target 40 will be in the middle position 72. When the pitch angle 90 of the propeller blade 1 is in feather, the sliding magnetic target 40 will be in the lower-most position 73.

Figure 4B:
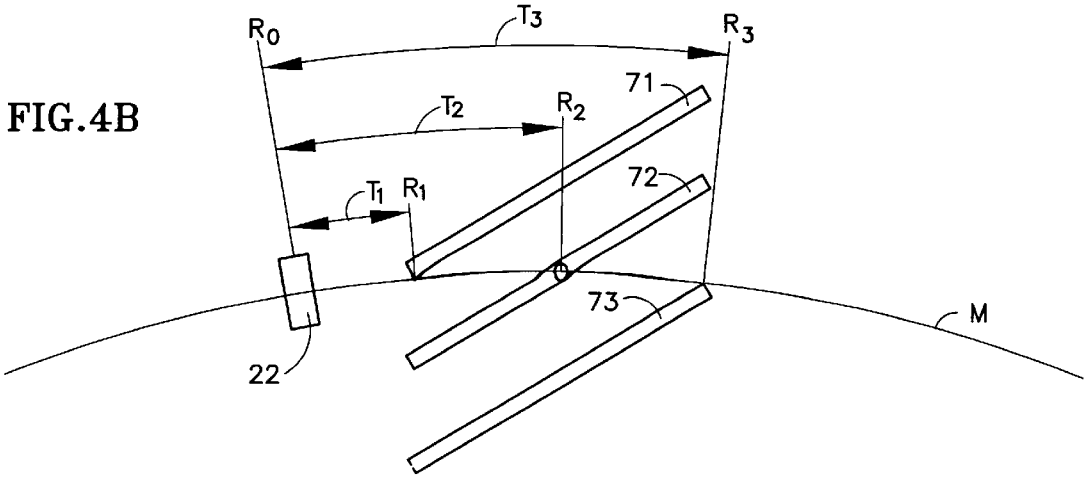
FIG. 4B is a timing diagram illustrating the relative positions of the fixed magnetic target and the sliding magnetic target during various propeller blade pitch angle positions.

Referring to FIG. 4B, a timing diagram illustrating the relative positions of the fixed magnetic target 22 and the sliding magnetic target 40 during various propeller blade pitch angle 90 positions is shown. The sensor arc M is defined as the spatial path which the fixed magnetic target 22 follows as it rotates on the bulkhead plate 20. The sensor arc M is also required to continually pass by the magnetic sensor 30 (not shown) and therefore for purposes of FIG. 4B, it may be considered that the magnetic sensor 30 lies on the sensor arc M.

Pitch angle 90 of the propeller blade 1 is calculated by the time interval detected between the output signal pulses which are generated as the fixed magnetic target 22 and the sliding magnetic target 40 pass by the magnetic sensor 30. As described above the magnetic sensor 30 has a centrally located magnetic pole piece 33. The sensitivity of the magnetic pole piece 33 is such that it only detects that portion of the magnetic bar 45 which lies on the sensor arc M. A reference radius $R_0$ indicates the origin of each of the timing arcs $T_1$, $T_2$, and $T_3$, which correspond respectively to the sliding magnetic target 40 in its upper-most position 71, middle position 72, and lower-most position 73. It is important to note that the magnetic bar 45 of the sliding magnetic target 40 is angled, approximately 45°, with respect to a tangent (not shown) of the sensor arc M at the various points where the sliding magnetic target 40 crosses the sensor arc M. In other words, the tail 42 has a longitudinal axis generally perpendicular to the axis 82 and the head 45 has a longitudinal axis that is at an oblique angle relative to the axis 82. Thus, as the sliding magnetic target 40 moves radially in and out from the center of the bulkhead plate 20, that portion of the magnetic bar 45 lying on the sensor arc M changes in radial position to $R_1$, $R_2$, and $R_3$. As long as the propeller is spinning at a relatively constant speed, then a signal processor can perform a calculation that will map the time interval detected $T_1$, $T_2$, or $T_3$ into a pitch angle.

The present invention provides an effective system for determining propeller pitch angle. Although the system has been described as using a magnetic sensor and magnetic transmitters, it is understood that other sensors and transmitters may be used and the invention is not limited to magnetic devices.

While preferred embodiments have been shown and described, various modifications and substitutions may be made thereto without departing from the spirit and scope of the invention. Accordingly, it is to be understood that the present invention has been described by way of illustrations and not limitation.

What is claimed is:

1. A propeller blade pitch angle indicating system comprising:

a hub assembly rotatable about a first axis;

a propeller blade rotatably mounted in said hub so as to rotate about a second axis;

a first transmitter rotating with said hub and transmitting a first signal;

a second transmitter coupled to said propeller blade and transmitting a second signal, a position of said second transmitter being responsive to an angle of rotation of said propeller blade about said second axis;

a sensor receiving said first signal and generating a first output output signal and receiving said second signal and generating a second output signal;

a grooved ring coupled to said propeller and rotatable about said second axis; and said second transmitter includes a head for passing proximate to said sensor and a tail positioned in said grooved ring;

wherein the relationship between said first output signal and said second output signal is indicative of rotation of the propeller about said second axis.

2. A propeller blade pitch angle indicating system as in claim 1 wherein:

said first transmitter is a permanent magnet;

said second transmitter is a permanent magnet; and said sensor is a magnetic sensor, said sensor generating said first output signal upon said first transmitter being in proximity said sensor and said sensor generating said second output signal upon said second transmitter being in proximity to said sensor.

3. A propeller blade pitch angle indicating system as in claim 1 wherein;

said grooved ring has a first end at a first position along said second axis and a second end at a second position along said second axis;

wherein rotation of said grooved ring about said second axis causes translation of said tail along said second axis.

4. A propeller blade pitch angle indicating system as in claim 1 wherein:

said tail has a longitudinal axis generally perpendicular to said second axis; and said head has a longitudinal axis at an oblique angle relative to said second axis.

5. A propeller blade pitch angle indicating system as in claim 1 wherein:

said head has a first end and a second end;

said first end passing proximate to said sensor when said tail is in a first position in said grooved ring; and said second end passing proximate to said sensor when said tail is in a second position in said grooved ring.

6. A propeller blade pitch angle indicating system as in claim 1 wherein:

said first transmitter is mounted on a bulkhead.

* * * * *